US010253283B2

(12) United States Patent
Somerville Roberts et al.

(10) Patent No.: US 10,253,283 B2
(45) **Date of Patent: *Apr. 9, 2019**

(54) PROCESS FOR WASHING FABRICS

(71) Applicant: The Procter & Gamble Company, Cincinnati, OH (US)

(72) Inventors: Nigel Patrick Somerville Roberts, Newcastle upon Tyne (GB); Carlos Amador Zamarreno, Newcastle upon Tyne (GB); Alan Thomas Brooker, Newcastle upon Tyne (GB); Robby Renilde Francois Keuleers, Lippelo (BE); Laura Bueno Romo, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/663,853

(22) Filed: Jul. 31, 2017

(65) Prior Publication Data

US 2018/0037851 A1 Feb. 8, 2018

(30) Foreign Application Priority Data

Aug. 4, 2016 (EP) ..... 16182713

(51) Int. Cl.

| | |
|---|---|
| ***D06F 35/00*** | (2006.01) |
| ***C11D 17/04*** | (2006.01) |
| ***D06F 33/02*** | (2006.01) |
| ***C11D 11/00*** | (2006.01) |
| ***D06F 33/00*** | (2006.01) |
| *D06F 39/02* | (2006.01) |

(52) U.S. Cl.

CPC ..... *C11D 17/043* (2013.01); *C11D 11/0017* (2013.01); *D06F 33/00* (2013.01); *D06F 33/02* (2013.01); *D06F 35/006* (2013.01); *D06F 39/024* (2013.01); *D06F 39/026* (2013.01)

(58) Field of Classification Search

CPC . C11D 17/043; C11D 11/0017; D06F 35/006; D06F 39/024; D06F 33/00

See application file for complete search history.

(56) References Cited

U.S. PATENT DOCUMENTS

| | | | | |
|---|---|---|---|---|
| 7,386,971 | B2 | 6/2008 | Catlin et al. | |
| 8,697,624 | B2 | 4/2014 | Denome et al. | |
| 9,550,962 | B2 | 1/2017 | Labeque et al. | |
| 2003/0199414 | A1* | 10/2003 | Boutique | C11D 3/2086 510/293 |
| 2008/0015135 | A1 | 1/2008 | De Buzzaccarini | |
| 2011/0061174 | A1 | 3/2011 | Boutique | |
| 2015/0158645 | A1 | 6/2015 | Meier et al. | |
| 2015/0275152 | A1* | 10/2015 | Brooker | C11D 17/042 510/296 |

FOREIGN PATENT DOCUMENTS

| | | |
|---|---|---|
| DE | 101 11 081 A1 | 10/2002 |
| EP | 2 570 474 A1 | 3/2013 |
| WO | WO 2004/072353 A1 | 8/2004 |
| WO | WO 2005/111186 A1 | 11/2005 |
| WO | WO 2015/181571 A1 | 12/2015 |

OTHER PUBLICATIONS

EP Search Report for (Application No. 16182713.4-1710 dated Feb. 23, 2017.

* cited by examiner

*Primary Examiner* — Eisa B Elhilo
(74) *Attorney, Agent, or Firm* — Gregory S. Darley-Emerson

(57) ABSTRACT

The present invention comprises a process of washing fabrics using a water-soluble unit dose article.

15 Claims, No Drawings

PROCESS FOR WASHING FABRICS

FIELD OF THE INVENTION

The present invention comprises a process of washing fabrics using a water-soluble unit dose article.

BACKGROUND OF THE INVENTION

Laundry wash operations involve the combination of fabrics to be washed with a detergent in a wash liquor. The wash liquor comprising the fabrics and detergent is then subjected to a wash operation. Oftentimes this is conducted in an automatic washing machine operation wherein the wash liquor is subjected to one or more cycles wherein each cycle involves the agitation of the wash liquor.

However, an issue with such wash operations is that often residues remain on the fabrics after the wash operation has finished. These residues are often undissolved detergent composition. This issue is especially seen under stressed wash conditions especially short and/or cold wash conditions. These short and/or cold wash conditions are becoming more popular as they are less environmentally impactful in that they are less resource and energy intensive. Stressed conditions can also include low agitation washes, overfilled washing machines and low water wash cycles. Such other stressed conditions also impact the energy and resource requirements of the wash operation and so generally are more environmentally friendly.

Therefore, there remains a need in the art for a laundry wash process that provides excellent fabric cleaning yet minimises detergent residues on fabrics under stressed wash conditions, especially under more environmentally friendly or stressed conditions such as cold and/or quick wash conditions.

The Inventors surprisingly found that the process of the present invention overcame this technical problem.

SUMMARY OF THE INVENTION

The present invention discloses a process for reducing detergent residues on fabrics during the laundry process comprising the steps of;

a. Obtaining a water-soluble unit dose article comprising a water-soluble film and between 4 ml and 35 ml of a liquid laundry detergent composition, wherein the liquid laundry detergent composition has a viscosity of at least 4.5 Pa·s at a shear rate of 0.5 $s^{-1}$ as measured using a TA Rheometer AR2000 at 25° C.;
b. Adding the water-soluble unit dose article to the drum of an automatic washing machine with fabrics to be washed, wherein preferably the fabrics comprise at least one stain or soil to be removed;
c. Washing the fabrics in an automatic washing machine wash cycle, wherein said cycle comprises a main wash step, wherein said main wash step takes between 5 minutes and 50 minutes.

DETAILED DESCRIPTION OF THE INVENTION

The Process

The present invention is to a process for reducing detergent residues on fabrics during the laundry process.

The process comprises the step of;

a. Obtaining a water-soluble unit dose article comprising a water-soluble film and between 4 ml and 35 ml of a liquid laundry detergent composition, wherein the liquid laundry detergent composition has a viscosity of at least 4.5 Pa·s at a shear rate of 0.5 $s^{-1}$ as measured using a TA Rheometer AR2000 at 25° C.

The water-soluble unit dose article, the water-soluble film and the liquid laundry detergent composition are described in more detail below.

The process comprises the further step of;

b. Adding the water-soluble unit dose article to an automatic washing machine, preferably the drum of an automatic washing machine with fabrics to be washed, wherein preferably the fabrics comprise at least one stain or soil to be removed.

The water-soluble unit dose article is preferably added to the drum of a washing machine. Alternatively, the water-soluble unit dose article may be added to the drawer of an automatic washing machine.

The water-soluble unit dose article may be added to the washing machine by hand. The water-soluble unit dose article may be added to the drum by hand. Alternatively it may be dispensed from a storage receptacle into the washing machine, preferably the drum. Those skilled in the art will be aware of relevant storage receptacles.

Those skilled in the art will be aware of suitable automatic washing machines. Those skilled in the art will also be aware that automatic washing machines comprise a drum and a drawer and will be able to locate said drum or drawer and add both the fabrics and the water-soluble unit dose article thereto accordingly.

By fabric we preferably mean a textile or cloth comprising a network of natural or artificial fibers. Those skilled in the art will be aware of suitable fabrics. Preferably the fabrics are ones that are worn by consumers such as clothing. Preferably the fabrics comprise at least one stain or soil to be removed. Those skilled in the art will be aware of suitable stains or soils to be removed.

The process comprises the further step of;

c. Washing the fabrics in an automatic washing machine wash cycle, wherein said cycle comprises a main wash step, wherein said main wash step takes between 5 minutes and 50 minutes.

Those skilled in the art will be aware of standard washing machine processes. The skilled person will know how to select such a process on a standard washing machine. Without wishing to be bound by theory, washing machine processes comprise at least a main wash step. They may comprise other steps such as one or more rinse steps, one or more pre-wash steps or a mixture thereof.

The main wash takes between 5 minutes and 50 minutes, preferably between 5 minutes and 40 minutes, more preferably between 5 minutes and 30 minutes, even more preferably between 5 minutes and 20 minutes, most preferably between 6 minutes and 18 minutes.

The main wash step may comprise the addition of between 7 L and 60 L, preferably between 7 L and 40 L, more preferably between 7 L and 30 L, most preferably between 7 L and 20 L of water to the drum of the automatic washing machine.

The temperature of the water in the main wash step may be between 7° C. and 90° C., preferably between 10° C. and 60° C., more preferably between 10° C. and 45° C., most preferably between 15° C. and 35° C.

The water in the main wash may have a water hardness varying from soft to medium to hard water. The water in the main wash may have a water hardness of from 0 to 40 gpg, typically 2 to 30 gpg most typically 5 to 20 gpg.

The automatic washing process may comprise at least one rinse step. The automatic washing machine process may comprise a final spin step, preferably wherein the drum of the automatic washing machine rotates at a speed of between 0 rpm and 1700 rpm, preferably between 200 rpm and 1500 rpm, more preferably 300 rpm and 1300 rpm, most preferably between 500 rpm and 1000 rpm.

The process may comprise between 1 kg and 12 kg, preferably between 4 kg and 10 kg, more preferably between 5 kg and 8 kg of fabrics to be washed, preferably wherein the fabrics comprise cotton fabrics, synthetic fabrics or a mixture thereof.

Preferably the wash process is selected from short wash process, cold wash process or quick wash process. Those skilled in the art will know how to select a water-soluble unit dose article having the properties required by the present invention.

Without wishing to be bound by theory, it is believed that it is the specific combination for washing steps of the present invention that overcomes the technical problem addressed. The step of choosing a specific laundry detergent composition together with the specific wash conditions used ensure minimized detergent residues on fabrics whilst still providing a wash process that is more environmentally friendly, or operates under more stressed conditions.

Water-Soluble Unit Dose Article

A further aspect of the present invention is a water-soluble unit dose article as described herein, comprising a water-soluble film and between 4 ml and 35 ml, preferably between 10 ml and 35 ml, more preferably between 15 ml and 32 ml, even more preferably between 18 ml and 30 ml, most preferably between 18 ml and 26 ml of a liquid laundry detergent composition, preferably, wherein the liquid laundry detergent is non-Newtonian, wherein the liquid laundry detergent composition has a viscosity of at least 4.5 Pa·s preferably at least 6 Pa·s, more preferably between 6 Pa·s and 25 Ps·a, even more preferably between 10 Pa·s and 20 Pa·s, most preferably between 12 Pa·s and 16 Pa·s at a shear rate of 0.5 $s^{-1}$ as measured using a TA Rheometer AR2000 at 25° C.

Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate.

The process comprises a step a) of obtaining a water-soluble unit dose article comprising a water-soluble film and between 4 ml and 35 ml of a liquid laundry detergent composition.

The water-soluble unit dose article comprises the water-soluble film shaped such that the unit-dose article comprises at least one internal compartment surrounded by the water-soluble film. The unit dose article may comprise a first water-soluble film and a second water-soluble film sealed to one another such to define the internal compartment. The water-soluble unit dose article is constructed such that the detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the detergent composition. During manufacture, a first water-soluble film may be shaped to comprise an open compartment into which the detergent composition is added. A second water-soluble film is then laid over the first film in such an orientation as to close the opening of the compartment. The first and second films are then sealed together along a seal region.

The unit dose article may comprise more than one compartment, even at least two compartments, or even at least three compartments. The compartments may be arranged in superposed orientation, i.e. one positioned on top of the other. In such an orientation the unit dose article will comprise three films, top, middle and bottom. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the detergent composition according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms.

The water-soluble unit dose article may comprise at least two internal compartments, wherein the liquid laundry detergent composition is comprised in at least one of the compartments, preferably wherein the unit dose article comprises at least three compartments, wherein the detergent composition is comprised in at least one of the compartments. If more than one compartment comprises a liquid formulation, at least one, preferably at least two, most preferably all of the compartments comprise a liquid detergent formulation having a viscosity of at least 4.5 Pa·s preferably at least 6 Pa·s, more preferably between 6 Pa·s and 25 Ps·a, even more preferably between 10 Pa·s and 20 Pa·s, most preferably between 12 Pa·s and 16 Pa·s at a shear rate of 0.5 $s^{-1}$ as measured using a TA Rheometer AR2000 at 25° C. If more than one compartment comprises a liquid formulation, and solely one or more but not all of the liquid detergent formulations have a viscosity of at least 4.5 Pa·s preferably at least 6 Pa·s, more preferably between 6 Pa·s and 25 Ps·a, even more preferably between 10 Pa·s and 20 Pa·s, most preferably between 12 Pa·s and 16 Pa·s at a shear rate of 0.5 $s^{-1}$ as measured using a TA Rheometer AR2000 at 25° C., preferably the largest compartment(s) comprising a liquid detergent composition comprises a liquid detergent formulation having a viscosity of at least 4.5 Pa·s preferably at least 6 Pa·s, more preferably between 6 Pa·s and 25 Ps·a, even more preferably between 10 Pa·s and 20 Pa·s, most preferably between 12 Pa·s and 16 Pa·s at a shear rate of 0.5 $s^{-1}$ as measured using a TA Rheometer AR2000 at 25° C.

The water-soluble unit dose article may comprise between 10 ml and 35 ml, preferably between 15 ml and 32 ml, more preferably between 18 ml and 30 ml, most preferably between 18 ml and 26 ml of the liquid laundry detergent composition.

The water-soluble unit dose article has a height, a width and a length, and wherein preferably;

the maximum length is between 2 and 10 cm, preferably 2 and 5 cm;

the maximum width is between 2 and 5 cm; and the maximum height is between 1 and 5 cm, preferably between 2 and 5 cm.

The maximum length may be between 2 cm and 4 cm, or even between 2 cm and 3 cm. The maximum length maybe greater than 2 cm and less than 6 cm.

The maximum width is between 2 cm and 5 cm. The maximum width maybe greater than 3 cm and less than 6 cm.

The maximum height maybe greater than 2 cm and less than 4 cm.

Preferably, the length:height ratio is from 6:1 to 1:1 more preferably 3:1 to 1:1; or the width:height ratio is from 3:1 to 1:1, or even 2.5:1 to 1:1; or the ratio of length to height is from 6:1 to 1:1 or even 3:1 to 1:1 and the ratio of width to height is from 3:1 to 1:1, or even 2.5:1 to 1:1, or a combination thereof.

The film of the present invention is soluble or dispersible in water and comprises at least one polyvinylalcohol or a copolymer thereof. Preferably, the water-soluble film comprises a blend of at least two different polyvinylalcohol homopolymers, at least two different polyvinylalcohol copolymers, at least one polyvinylalcohol homopolymer and at least one polyvinylalcohol copolymer or a combination thereof.

The water-soluble film preferably has a thickness of from 20 to 150 micron, preferably 35 to 125 micron, even more preferably 50 to 110 micron, most preferably from about 70 to 90 microns especially about 76 micron. By film thickness, we herein mean the thickness of the film prior to any deformation during manufacture.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Preferably, the water-soluble unit dose article comprises polyvinylalcohol.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol.

Preferred for use herein are PVA polymers which are from about 60% to about 98% hydrolysed, preferably about 80% to about 90% hydrolysed, to improve the dissolution characteristics of the material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol.

Of the total PVA resin content in the film described herein, the PVA resin can comprise about 30 to about 85 wt % of the first PVA polymer, or about 45 to about 55 wt % of the first PVA polymer. For example, the PVA resin can contain about 50 w. % of each PVA polymer, wherein the viscosity of the first PVA polymer is about 13 cP and the viscosity of the second PVA polymer is about 23 cP, measured as a 4% polymer solution in demineralized water at 20° C.

Preferably the film comprises a blend of at least two different polyvinylalcohol homopolymers and/or copolymers.

Most preferably the water soluble film comprises a blend of at least two different polyvinylalcohol homopolymers, especially a water soluble film comprising a blend of at least two different polyvinylalcohol homopolymers of different average molecular weight, especially a blend of 2 different polyvinylalcohol homopolymers having an absolute average viscosity difference $|\mu_2-\mu_1|$ for the first PVOH homopolymer and the second PVOH homopolymer, measured as a 4% polymer solution in demineralized water, in a range of 5 cP to about 15 cP, and both homopolymers having an average degree of hydrolysis between 85% and 95% preferably between 85% and 90%. The first homopolymer preferably has an average viscosity of 10 to 20 cP preferably 10 to 15 cP The second homopolymer preferably has an average viscosity of 20 to 30 cP preferably 20 to 25 cP. Most preferably the two homopolymers are blended in a 40/60 to a 60/40 weight % ratio.

Alternatively the water soluble film comprises a polymer blend comprising at least one copolymer comprising polyvinylalcohol and anionically modified monomer units. In particular the polymer blend might comprise a 90/10 to 50/50 weight % ratio of a polyvinylalcohol homopolymer and a copolymer comprising polyvinylalcohol and anionically modified monomer units. Alternatively the polymer blend might comprise a 90/10 to 10/90 weight % ratio of two different copolymers comprising polyvinylalcohol and anionically modified monomer units.

General classes of anionic monomer units which can be used for the PVOH copolymer include the vinyl polymerization units corresponding to monocarboxylic acid vinyl monomers, their esters and anhydrides, dicarboxylic monomers having a polymerizable double bond, their esters and anhydrides, vinyl sulfonic acid monomers, and alkali metal salts of any of the foregoing. Examples of suitable anionic monomer units include the vinyl polymerization units corresponding to vinyl anionic monomers including vinyl acetic acid, maleic acid, monoalkyl maleate, dialkyl maleate, monomethyl maleate, dimethyl maleate, maleic anhydride, fumaric acid, monoalkyl fumarate, dialkyl fumarate, monomethyl fumarate, dimethyl fumarate, fumaric anhydride, itaconic acid, monomethyl itaconate, dimethyl itaconate, itaconic anhydride, vinyl sulfonic acid, allyl sulfonic acid, ethylene sulfonic acid, 2-acrylamido-1-methylpropanesulfonic acid, 2-acrylamido-2-methylpropanesulfonic acid, 2-methylacrylamido-2-methylpropanesulfonic acid, 2-sulfoethyl acrylate, alkali metal salts of the foregoing (e.g., sodium, potassium, or other alkali metal salts), esters of the foregoing (e.g., methyl, ethyl, or other $C_1$-$C_4$ or $C_6$ alkyl esters), and combinations thereof (e.g., multiple types of anionic monomers or equivalent forms of the same anionic monomer). In an aspect, the anionic monomer can be one or more acrylamido methylpropanesulfonic acids (e.g., 2-acrylamido-1-methylpropanesulfonic acid, 2-acrylamido-2-methylpropanesulfonic acid, 2-methylacrylamido-2-methylpropanesulfonic acid), alkali metal salts thereof (e.g., sodium salts), and combinations thereof. In an aspect, the anionic monomer can be one or more of monomethyl maleate, alkali metal salts thereof (e.g., sodium salts), and combinations thereof.

The level of incorporation of the one or more anionic monomer units in the PVOH copolymers is not particularly limited. In some aspects, the one or more anionic monomer units are present in a PVOH copolymer in an amount in a range of about 2 mol. % to about 10 mol. % (e.g., at least 2.0, 2.5, 3.0, 3.5, or 4.0 mol. % and/or up to about 3.0, 4.0, 4.5, 5.0, 6.0, 8.0, or 10 mol. % in various embodiments), individually or collectively.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, dipropylene glycol, sorbitol and mixtures thereof. Other additives may include water and functional detergent additives, including surfactant, to be delivered to the wash water, for example organic polymeric dispersants, etc.

The film may be opaque, transparent or translucent. The film may comprise a printed area. The printed area may cover between 10% and 80% of the surface of the film; or between 10% and 80% of the surface of the film that is in contact with the internal space of the compartment; or between 10% and 80% of the surface of the film and between 10% and 80% of the surface of the compartment.

The area of print may cover an uninterrupted portion of the film or it may cover parts thereof, i.e. comprise smaller areas of print, the sum of which represents between 10% and 80% of the surface of the film or the surface of the film in contact with the internal space of the compartment or both.

The area of print may comprise inks, pigments, dyes, blueing agents or mixtures thereof. The area of print may be opaque, translucent or transparent.

The area of print may comprise a single colour or maybe comprise multiple colours, even three colours. The area of print may comprise white, black, blue, red colours, or a mixture thereof. The print may be present as a layer on the surface of the film or may at least partially penetrate into the film. The film will comprise a first side and a second side. The area of print may be present on either side of the film, or be present on both sides of the film. Alternatively, the area of print may be at least partially comprised within the film itself.

The area of print may comprise an ink, wherein the ink comprises a pigment. The ink for printing onto the film has preferably a desired dispersion grade in water. The ink may be of any color including white, red, and black. The ink may be a water-based ink comprising from 10% to 80% or from 20% to 60% or from 25% to 45% per weight of water. The ink may comprise from 20% to 90% or from 40% to 80% or from 50% to 75% per weight of solid.

The ink may have a viscosity measured at 20° C. with a shear rate of 1000 $s^{-1}$ between 1 and 600 cPs or between 50 and 350 cPs or between 100 and 300 cPs or between 150 and 250 cPs. The measurement may be obtained with a cone-plate geometry on a TA instruments AR-550 Rheometer.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either or both sides of the film.

Alternatively, an ink or pigment may be added during the manufacture of the film such that all or at least part of the film is coloured.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 ppm.

Liquid Laundry Detergent Composition

The composition of the present invention is a liquid laundry detergent composition. The term 'liquid laundry detergent composition' refers to any laundry detergent composition comprising a liquid capable of wetting and treating a fabric, and includes, but is not limited to, liquids, gels, pastes, dispersions and the like. The liquid composition can include solids or gases in suitably subdivided form, but the liquid composition excludes forms which are non-fluid overall, such as tablets or granules.

Preferably, the liquid laundry detergent composition is non-Newtonian. Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate.

The liquid laundry detergent composition has a viscosity of between 4.5 Pa·s and 80 Pa·s, preferably between 6 Pa·s, and 75 Ps·a, more preferably between 10 Pa·s and 70 Pa·s, most preferably between 12 Pa·s and 60 Pa·s at a shear rate of 0.5 $s^{-1}$ as measured using a TA Rheometer AR2000 at 25° C. Preferably the liquid laundry detergent composition has a viscosity of between 0.5 Pa·s and 2 Pa·s at a shear rate of 100 $s^{-1}$ as measured using a TA Rheometer AR2000 at 25° C.

The liquid detergent composition may comprise a rheology modifier, preferably selected from hydrogenated castor oil, microfibrous cellulose, polyacrylates and a mixture thereof, preferably wherein the rheology modifier is hydrogenated castor oil. Preferably, the liquid laundry detergent composition comprises between 0.15% and 1%, preferably between 0.15% and 0.75%, more preferably between 0.15% and 0.5%, most preferably between 0.175% and 0.3% by weight of the liquid laundry detergent composition of hydrogenated castor oil.

The liquid laundry detergent composition may comprise a brightener, a hueing dye or a mixture thereof.

The liquid laundry detergent composition may comprise a surfactant, wherein the surfactant is preferably selected from anionic surfactants, non-ionic surfactants, amphoteric surfactants and a mixture thereof.

The anionic surfactant may comprise a non-soap anionic surfactant, a soap or a mixture thereof.

The liquid laundry detergent composition may comprise between 5% and 45%, preferably between 10% and 40%, more preferably between 15% and 35%, most preferably between 20% and 30% by weight of the liquid detergent composition of the non-soap anionic surfactant.

The liquid laundry detergent composition may comprise between 5% and 35%, preferably between 5% and 20%, more preferably between 5% and 15% by weight of the liquid laundry detergent composition of the non-soap anionic surfactant.

The non-soap anionic surfactant may be selected from linear alkylbenzene sulphonate, alkyl sulphate, alkoxylated alkyl sulphate or a mixture thereof. Preferably, the non-soap anionic surfactant comprises linear alkylbenzene sulphonate and alkoxylated alkyl sulphate and the weight ratio of linear alkylbenzene sulphonate to alkoxylated alkyl sulphate is from 2:1 to 1:8 preferably from 1:1 to 1:5 most preferably from 1:1.25 to 1:4.

The liquid laundry detergent composition may comprise a non-ionic surfactant, preferably wherein the non-ionic surfactant is selected from a fatty alcohol alkoxylate, an oxo-synthesised fatty alcohol alkoxylate, Guerbet alcohol alkoxylates, alkyl phenol alcohol alkoxylates or a mixture thereof. Preferably, the liquid laundry detergent composition comprises between 1% and 25%, preferably between 1.5% and 20%, most preferably between 2% and 15% by weight of the liquid laundry detergent composition of the non-ionic surfactant.

The weight ratio of non-soap anionic surfactant to non-ionic surfactant may be from 1:1 to 20:1, preferably from 1.3:1 to 15:1, more preferably from 1.5:1 to 10:1.

The liquid detergent composition may comprise between 1% and 25%, preferably between 1.5% and 20%, more preferably between 1% and 25%, preferably between 1.5% and 20%, most preferably between 2% and 15% by weight of the liquid detergent composition of soap.

The liquid laundry detergent composition may comprise a cleaning or care polymer, preferably wherein the cleaning or care polymer is selected from an ethoxylated polyethyleneimine, alkoxylated polyalkyl phenol, an amphiphilic graft copolymer, a polyester terephthalate, a hydroxyethylcellulose, a carboxymethylcellulose or a mixture thereof.

Use of a Water-Soluble Unit Dose Article

A further aspect of the present invention is the use of the water-soluble unit dose article according to the present invention where said unit dose article comprises a water-soluble film and between 4 ml and 35 ml of a liquid laundry detergent composition, wherein the liquid laundry detergent is non-Newtonian, wherein the liquid laundry detergent composition has a viscosity of at least 4.5 Pa·s at a shear rate of 0.5 $s^{-1}$ as measured using a TA Rheometer AR2000 at 25° C. for reducing detergent residues on fabrics during a laundry process according to the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

EXAMPLES

A process according to the present invention was compared to a wash process outside of the scope of the claims in order to assess impact of detergent residue deposition of fabrics that have been washed.

Two water-soluble unit dose articles were prepared comprising polyvinyl alcohol containing film and liquid laundry detergent compositions. The liquid laundry detergent compositions differed in viscosity. The rheological profile of the liquid laundry detergent products was obtained using a TA Rheometer AR2000 at room temperature (25° C.). Pre-shear of samples was carried out at 50 $s^{-1}$ for 30 s, afterwards the shear rate was continuously increased from 0.1 $s^{-1}$-2000 $s^{-1}$ over 7 minutes.

The liquid laundry detergent composition of water-soluble unit dose article 1 had a viscosity of 0.9 Pa·s at a shear rate of 0.5 $s^{-1}$ measured as described above (outside of scope).

The liquid laundry detergent composition of water-soluble unit dose article 2 had a viscosity of 69 Pa·s at a shear rate of 0.5 $s^{-1}$ measured as described above (within scope).

A Miele 1714 Front Loader Washing Machine (FLWM) with 4 kg of fabric ballast load (EMPA 221 commercial available from http://www.swissatest.ch/en/shop.html.) was prepared. The washing cycle selected was a short (20 min) and cold (20° C.) cotton cycle with a main wash volume of 12 L. Three replicates of each of the water-soluble unit dose articles were added to the washing machine per wash placing them evenly distributed at the bottom, middle and top of the ballast load (always covered by fabrics).

Dissolution kinetics of the unit dose articles was tracked by conductivity connecting a flow cell to the outer drum of the washing machine via 2 mm tubing. The flow cell pumped a small volume of wash liquor from the drum to measure conductivity and returned it into the washing machine.

Results can be seen in table 1 below;

TABLE 1

| | % unit dose article dissolved | |
|---|---|---|
| Time (min) | Unit dose article 1 | Unit dose article 2 |
| 0 | 0 | 0 |
| 1 | 0 | 0 |
| 3 | 7 | 4 |
| 5 | 32 | 49 |
| 8 | 84 | 96 |
| 11 | 91 | 99 |
| 13 | 95 | 99 |

As can be seen from Table 1, initially, an induction period is observed while the unit dose article break and the washing machine is filling with water. Surprisingly, a slower dissolution profile of the unit dose article used in the comparative wash process is observed. This is especially surprisingly as it is the general belief in the art that lower viscous products dissolve faster under these environmentally friendly wash conditions.

Without wishing to be bound by theory it is believed that the process of the present invention allows detergent composition to penetrate into fabrics more slowly whilst still maintaining environmentally friendly wash conditions. Quick penetration in fabrics of detergent composition means it is more difficult to wash out under environmentally friendly conditions therefore causing delay in unit dose article dissolution and hence fabric residues accordingly.

Indeed, by the end of the test, the wash process comprising water-soluble unit dose article 1 exhibits more undissolved water-soluble unit dose article as measured by a lower conductivity value (in relation to the conductivity value of 100% of detergent dissolved) than in the wash process comprising water-soluble unit dose article 2. This lower dissolution translates as higher levels of material that can result in residues on fabrics.

Hence, the wash process of the present invention results in lower detergent residues on fabrics whilst still providing for a more environmentally friendly/lower resource intensive wash process.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for reducing detergent residues on fabrics during the laundry process comprising the steps of:

a. obtaining a water-soluble unit dose article comprising a water-soluble film and between about 4 ml and about 35 ml of a liquid laundry detergent composition, wherein the liquid laundry detergent composition has a viscosity of at least about 4.5 Pa·s at a shear rate of about 0.5 $s^{-1}$ as measured using a TA Rheometer AR2000 at about 25° C.;

b. adding the water-soluble unit dose article to an automatic washing machine the drum of an automatic washing machine with fabrics to be washed, wherein the fabrics comprise at least one stain or soil to be removed;

c. washing the fabrics in an automatic washing machine wash cycle, wherein said cycle comprises a main wash step, wherein said main wash step takes between about 5 minutes and about 50 minutes.

2. The process according to claim 1 wherein the main wash step takes between about 5 minutes and about 40 minutes to complete.

3. The process according to claim 1, wherein said main wash step comprises the addition of between about 7 L and about 60 L of water to the drum of the automatic washing machine.

4. The process according to claim 1 wherein the temperature of the water in the main wash step is between about 10° C. and about 45° C.

5. The process according to claim 1, wherein the automatic washing machine wash cycle comprises a final spin step, wherein the drum of the automatic washing machine rotates at a speed of between about 0 rpm and about 1700 rpm.

6. The process according to claim 1 wherein the process comprises between about 1 kg and about 12 kg of the fabrics to be washed.

7. The process according to claim 1 wherein the fabrics comprise cotton fabrics, synthetic fabrics or a mixture thereof.

8. The process according to claim 1 wherein the liquid laundry detergent composition has a viscosity of between about 4.5 Pa·s and about 35 Pa·s, at a shear rate of about 0.5 $s^{-1}$ as measured using a TA Rheometer AR2000 at about 25° C., and a viscosity of between about 0.5 Pa·s and about 2 Pa·s at a shear rate of about 100 $s^{-1}$ as measured using a TA Rheometer AR2000 at about 25° C.

9. The process according to claim 1 wherein the liquid laundry detergent composition comprises rheology modifier, selected from hydrogenated castor oil, microfibrous cellulose, polyacrylates and a mixture thereof.

10. The process according to claim 9 wherein the liquid laundry detergent composition comprises between about 0.15% to about 1%, by weight of the liquid laundry detergent composition of hydrogenated castor oil.

11. The process according to claim 1 wherein the liquid laundry detergent composition comprises a brightener, a hueing dye or a mixture thereof.

12. The process according to claim 1 wherein the water-soluble unit dose article comprises between about 10 ml and about 35 ml of the liquid laundry detergent composition.

13. The process according to claim 1 wherein the liquid laundry detergent composition is non-Newtonian.

14. The process according to claim 1 wherein the water-soluble unit dose article comprises at least one compartment.

15. The process according to claim 1 wherein the water-soluble unit dose article has a height, a width and a length, and wherein;

the maximum length is between about 2 and about 10 cm;

the maximum width is between about 2 and about 5 cm; and the maximum height is between about 1 and about 5 cm.

* * * * *